US007563303B2

(12) United States Patent
Sorrentino et al.

(10) Patent No.: US 7,563,303 B2
(45) Date of Patent: Jul. 21, 2009

(54) STEEL DESULPHURATING AGENT AND USE THEREOF IN THE DESULPHURATION OF STEEL

(75) Inventors: François Sorrentino, Meyzieu (FR); Michel Gimenez, Diemoz (FR)

(73) Assignee: Lafarge, Paris (FR)

( * ) Notice: Subject to any disclaimer, the term of this patent is extended or adjusted under 35 U.S.C. 154(b) by 271 days.

(21) Appl. No.: 10/584,214

(22) PCT Filed: Dec. 23, 2004

(86) PCT No.: PCT/FR2004/050754

§ 371 (c)(1),
(2), (4) Date: Jun. 23, 2006

(87) PCT Pub. No.: WO2005/064022

PCT Pub. Date: Jul. 14, 2005

(65) Prior Publication Data

US 2007/0144306 A1 Jun. 28, 2007

(30) Foreign Application Priority Data

Dec. 24, 2003 (FR) ..... 03 51202

(51) Int. Cl.

| | |
|---|---|
| ***C21B 3/02*** | (2006.01) |
| ***C21B 5/02*** | (2006.01) |
| ***C21B 7/06*** | (2006.01) |
| ***C21C 5/02*** | (2006.01) |
| ***C21C 7/04*** | (2006.01) |
| ***C22B 7/04*** | (2006.01) |
| ***C22B 9/10*** | (2006.01) |

(52) U.S. Cl. ..... 75/306

(58) Field of Classification Search ..... 75/10.45, 75/306

See application file for complete search history.

(56) References Cited

U.S. PATENT DOCUMENTS

| | | | | |
|---|---|---|---|---|
| 4,560,405 | A | 12/1985 | Hanmyo et al. | |
| 2006/0118006 | A1 * | 6/2006 | Amathieu et al. | 106/611 |

FOREIGN PATENT DOCUMENTS

| | | | |
|---|---|---|---|
| FR | 2 541 310 | A | 8/1984 |
| JP | 05 117735 | A | 5/1993 |
| JP | 06 228626 | A | 8/1994 |
| JP | 2002-060832 | A | 2/2002 |
| JP | 2002-339014 | A | 11/2002 |
| JP | 2003-129122 | A | 5/2003 |
| JP | 2003-328022 | A | 12/2003 |

OTHER PUBLICATIONS

Vikhlevshchuk V A et al.: "Complex Practive for Producing Low Sulphur Steel," Steel in the USSR, Metals Society. London, GB, vol. 18, No. 3, Mar. 1, 1988, pp. 107-109, XP000023501, pp. 107-109.

* cited by examiner

*Primary Examiner*—George Wyszomierski
*Assistant Examiner*—Weiping Zhu
(74) *Attorney, Agent, or Firm*—Pillsbury Winthrop Shaw Pittman, LLP

(57) ABSTRACT

A low cost steel desulphurating agent includes, compared with the total weight of the agent, at least 10% of $SiO_2$, at least 10% of C2S, and at least 35% of at least one of calcium aluminate or calcium silico-aluminate. The desulphurating agent can include, compared with the total weight of the agent, the following mineralogical phases: 10 to 60% of C2S, 0 to 50% of C3A, 0 to 50% of C2AS, 0to 70% of C12A7, and 0 to 60% of CA.

11 Claims, No Drawings

STEEL DESULPHURATING AGENT AND USE THEREOF IN THE DESULPHURATION OF STEEL

BACKGROUND OF THE INVENTION

1. Field of the Invention

The invention relates to the area of metallurgy and relates particularly to an agent for desulphurating steel, comprising high concentrations of $SiO_2$, C2S, and calcium aluminate, and the use thereof in the desulphuration of steel.

2. Description of the Related Art.

Steel manufacture can be carried out schematically in two ways:

transforming iron ore into steel by means such as blast furnaces or converters, and processing scrap iron in an electric furnace.

It is known that the presence of impurities, phosphorus and sulphur in the steel obtained after refining cast iron is particularly harmful to mechanical properties. It is a known fact that the presence of a high proportion of sulphur in steel obtained after purification of cast iron produced by blast furnaces is particularly harmful because the sulphur reduces the cold ductility, the impact resistance, and the quality of the ingot surface. The proportion of sulphur that can be tolerated in the metal must be very low, that is to say, under 0.02% or even under 0.005%.

One of the major steps in the current process for steel production is primary metallurgy, by converter or electric furnace, which gives steel that is then reprocessed in a ladle in order to give it specific properties. The most notable progress in the area of improving the properties of steel has been from ladle metallurgy.

Devices for purifying cast iron and producing steel (blast furnaces, converters) make it possible to reduce the sulphur content of the metal, however they do not lead to the total desulphuration that would be necessary to remove the aforementioned disadvantages, whence the need to refine the steel. The general principles of refining can be summarised as described in the text that follows.

In order to extract the impurities from the steel, it has to be put in close contact with a product that has a greater affinity for the impurities, which therefore possesses a lower free enthalpy. This is a problem of thermodynamic equilibrium which can be solved by using high temperatures.

In order to lower the concentration in components that are deemed to have a noxious effect on the steel, the main methods of refining are:

1—exchange through a slag

2—forming insoluble compounds

3—decreasing the solubility of the impurities in the steel by lowering their partial pressure by applying a vacuum to the steel.

The chemical reaction for the desulphuration of steel is as follows:

$$[S]_m+(O^-)_s \rightarrow (S^-)_s+[O]_m,$$

wherein $[S]_m$ and $[O]_m$ are the components dissolved in the metal, and $(O^-)_s$ and $(S^-)_s$ are the components dissolved in the slag.

A usual method for lowering the concentration in components that are deemed to have a noxious effect on the steel is to use a lime-based slag: In this case, the reaction would be as follows:

$$[S]_m+(CaO)_s \rightarrow (CaS_2)_s+[O]_m$$

wherein $[S]_m$ and $[O]_m$ are the components dissolved in the metal, and $(CaO)_s$ and $(CaS_2)_s$ are the components dissolved in the slag.

As an indication, Table 1 lists in % by weight the usual mineralogical and/or chemical compositions of steelworks slag.

TABLE 1

| | C2S | Ferrite | Free CaO | Wustite | Periclase | C | TiO2 | $V_2O_5$ | $Cr_2O_3$ | MnO |
|---|---|---|---|---|---|---|---|---|---|---|
| Min | 15 | 10 | 1 | 3 | 2 | 0.02 | 0.3 | 0.2 | 0.20 | 0.5 |
| Max | 40 | 50 | 15 | 20 | 15 | 0.3 | 1.5 | 0.5 | 20.00 | 10 |
| | ZnO | CoO | NiO | CuO | PbO | BaO | SrO | P2O5 | S | Na2O |
| Min | 0.01 | 0.0001 | 0.01 | 0.005 | 0.0001 | 0.001 | 0.001 | 0.05 | 0.01 | 0.05 |
| Max | 0.5 | 0.001 | 0.5 | 0.5 | 0.005 | 0.5 | 0.05 | 2 | 2.00 | 0.5 |
| | K2O | ZrO2 | MoO | BeO | Tl | Sn2O3 | As2O3 | CdO | Cl | F |
| Min | 0.02 | 0.02 | 0.0001 | 0.0001 | 0 | 0.0001 | 0.0001 | 0.0001 | 0.05 | 0.0001 |
| Max | 0.5 | 0.5 | 0.001 | 0.001 | 0.0005 | 0.2 | 0.005 | 0.05 | 2.00 | 0.5 |

Among the methods currently used for desulphuration however, none is totally satisfying.

Thus the use of sodium carbonate results in a yield of the order of 60% maximum of desulphuration with emission of noxious smoke and the production of particularly aggressive slag.

The use of calcium carbide results in recarburising the metal, and also, the product must be kept dry to avoid the risk of producing acetylene thus causing an explosion.

The use of calcium cyanamide results in nitriding and carburising the metal, which is what is trying to be avoided.

Magnesium is difficult to use because it vaporises on contact with the steel and can result in explosions, and so must be coated in tar and placed in a bell.

The use of silico-calcium, blown into the mass to be purified results in globularisation of the inclusions, and requires the use of alkaline slag and causes the steel to regain nitrogen.

The use of lime is advantageous, but its high melting point, about 2200° C., stops the lime reacting with the liquid metal.

Much research has led to the conclusion that a product with sound desulphuration qualities could contain 53 to 55% of CaO, 43 to 45% of $Al_2O_3$ and 1% of FeO. Many products exist with this type of composition such as those described in the French patent FR2541310, filed on 18 Feb. 1983 or the products available from Wacker and also the slag from vanadium production.

However, these products are expensive or not readily available.

SUMMARY OF THE INVENTION

Thus a need exists for desulphurating agents which remedy the disadvantages described above, while remaining less expensive, more readily available than the state of the art compositions, and in particular which could be obtained from industrial waste, particularly from steelworks slag.

The aforementioned aims are met according to the invention, by a steel desulphurating agent comprising, compared with the total weight of the agent:

at least 10% of $SiO_2$, at least 10% of C2S, and at least 35% of at least one calcium aluminate and optionally a calcium silico-aluminate.

The composition of the desulphurating agent, comprising a high concentration of C2S makes it possible, apart from the advantages described above, to obtain a swelling of the desulphurating agent, and thus a powder.

DETAILED DESCRIPTION OF THE INVENTION

The desulphurating agent is preferably in the form of a powder with a specific surface comprised between 1000 and 5000 $cm^2/g$, preferably from 1000 to 2000 $cm^2/g$. Methods for measuring the specific surface of a powder are well known to those skilled in the art. Examples that can be quoted include processes based on the physical adsorption of a gas at low temperature, for example the well-known method known as BET.

Preferably, the desulphurating agent comprises the following mineralogical phases compared with the total weight of the agent:

10 to 60% of C2S, 0 to 50% of C3A, 0 to 50% of C2AS, 0 to 70% of C12A7, and 0 to 60% of CA, as long as the composition comprises at least 35% of calcium aluminate or a mixture of calcium aluminate and calcium silico-aluminate.

Most preferably, the desulphurating agent comprises the following mineralogical phases compared with the total weight of the agent:

10 to 30% of C2S, 30 to 60% of CA, and 10 to 40% of C2AS; or 20 to 50% of C2S, 20 to 70% of C12A7 and 0 to 40% of C3A, preferably 10 to 40% of C3A.

Preferably, the desulphurating agent is obtained from steelworks slag. This embodiment of the invention is particularly advantageous from an economic point of view, because it makes it possible to add value to steelworks by-products.

The desulphurating agent of the invention can be obtained by processing a molten steelworks slag in a controlled oxidising atmosphere so as to change its mineralogical and chemical composition and remove the impurities so that it can act as a sponge instead of the mixture of lime and furnace additions usually used for refining.

In particular, a method for preparing the desulphurating agent can consist in making a mixture of alumina or products that generate alumina and steelworks slag, then heating the mixture to a temperature comprised between 1250° C. and 1450° C., in a partial oxygen pressure, comprised between $10^{-1}$ and $10^{-6}$ bar.

The alumina, or the product generating alumina, can be added to the molten steelworks slag.

In general, the quantity of alumina that needs to be added to obtain the desulphurating agent from steelworks slag is between 10 and 30% compared to the total weight of the slag, depending on the composition of the slag and/or the required composition of the desulphurating agent.

The addition of alumina or of a compound that generates alumina makes the slag easier to melt and more readily desulphurised. Preferably, the source of alumina is selected from among: bauxite, aluminium residues and red mud.

The invention also relates to a steel desulphuration method comprising the addition to the steel of the desulphurating agent as described above and lime (CaO).

Preferably the desulphurating agent and the lime are mixed together before being added to the steel.

Preferably the weight ratio of the desulphurating agent to the lime varies from 1/0.5 to 1/2, and preferably is 1/1.

The steel desulphuration process preferably takes place at a temperature comprised between 1500° C. and 1600° C., and most preferably at 1550° C.

EXAMPLES

Desulphurating agents according to the invention were prepared from raw materials the mineralogical composition of which is shown in Table 2.

TABLE 2

| | SLAG | BAUXITE |
|---|---|---|
| SiO2 | 14.00 | 11.69 |
| CaO | 45.54 | 4.39 |
| $Al_2O_3$ | 1.16 | 57.75 |
| $Fe_2O_3$ | 24.61 | 21.60 |
| MgO | 5.20 | 0.43 |
| K2O | 0.05 | 0.16275 |
| Na2O | 0.18 | 0.16275 |
| S | 0.28 | 0.08138 |
| $TiO_2$ | 0.59 | 2.72030 |
| MnO | 4.73 | 0.25575 |
| $P_2O_5$ | 0.28 | 0.13950 |
| $Cr_2O_3$ | 0.88 | 0.23250 |

The slag and the bauxite were mixed at a temperature comprised between 1250° C. and 1450° C., in a partial oxygen pressure, comprised between $10^{-1}$ et $10^{-6}$ bar, then mixed with lime in proportions, expressed in percent by weight, given in Table 3.

TABLE 3

| | N°1 | N°2 | N°3 | N°4 | N°5 | N°6 |
|---|---|---|---|---|---|---|
| Slag | 32 | 28 | 15 | 16 | 45 | 72 |
| Bauxite | 53 | 53 | 47 | 45 | 35 | 22 |
| Lime | 14 | 19 | 38 | 39 | 20 | 6 |

The mineralogical phase composition of the desulphurating agents obtained from the compositions described in Table 3 is given in Table 4 below.

TABLE 4

| | Test 1 | Test 2 | Test 3 | Test 4 | Test 5 | Test 6 |
|---|---|---|---|---|---|---|
| C2S | 14 | 28 | 31 | 23 | 37 | 47 |
| CA | 38 | 52 | | | | |
| C2AS | 36 | 10 | | | | |
| C12A7 | | | 59 | 27 | 39 | 26 |
| C3A | | | | 40 | 14 | 13 |
| $Fe_2O_3$ | 0.4210 | 0.4210 | 1.4883 | 0.9012 | 0.9008 | 4.9056 |
| MgO | 7.8819 | 5.8786 | 5.4049 | 6.0905 | 5.0091 | 5.5339 |
| $K_2O$ | 0.1811 | 0.1567 | 0.1323 | 0.2481 | 0.1465 | 0.1476 |
| $Na_2O$ | 0.0453 | 0.0157 | 0.0000 | 0.0248 | 0.0293 | 0.0590 |
| S | 0.2900 | 0.1800 | 0.1200 | 0.2200 | 0.1500 | 0.0500 |
| TiO2 | 2.6713 | 2.7261 | 2.4312 | 2.1588 | 1.9629 | 1.9781 |
| MnO | 0.7093 | 0.6110 | 0.9923 | 0.1985 | 1.7725 | 0.8267 |
| $P_2O_5$ | 0.1000 | 0.0500 | 0.0400 | 0.0100 | 0.1500 | 0.1200 |
| $Cr_2O_3$ | 0.0100 | 0.0100 | 0.0200 | 0.0100 | 0.0600 | 0.0400 |

The capacity of the desulphurating agents was laboratory tested. The desulphurating agents were mixed with molten steel in a weight ratio of 1/1. The concentrations (W/W) of sulphur in the molten steel and in the desulphurating agent were measured by X fluorescence, before and after treating the steel with the desulphurating agent. The results are given in Table 5.

TABLE 5

| | Before desulphuration | After desulphuration |
|---|---|---|
| Molten steel | 0.07% | 0.01% |
| Desulphurating agent | 0.022% | 0.088% |

The results given in Table 5 show that the sulphur concentration in the molten metal decreases by a factor of 7 after treatment with the desulphurating agent. These tests clearly confirm the advantages of the use of desulphurating agents according to the invention for decreasing the sulphur concentration of molten metal.

The invention claimed is:

1. A steel desulphurating agent, comprising, compared with the total weight of the agent:

at least 10% of $SiO_2$, at least 10% of C2S, and at least 35% of at least one of calcium aluminate or calcium silico-aluminate.

2. The steel desulphurating agent according to claim 1, comprising compared with the total weight of the agent, the following mineralogical phases:

10 to 60% of C2S, 0 to 50% of C3A, 0 to 50% of C2AS, 0 to 70% of C12A7, and 0 to 60% of CA.

3. The steel desulphurating agent according to claim 1, comprising compared with the total weight of the agent, the following mineralogical phases:

10% to 60% of C2S, greater than 0% to 50% of C3A, greater than 0% to 50% of C2AS, greater than 0% to 70% of C12A7, and greater than 0% to 60% of CA.

4. The steel desulphurating agent according to claim 1, comprising, compared with the total weight of the agent, the following mineralogical phases:

10 to 30% of C2S, 30 to 60% of CA, and 10 to 40% of C2AS; or 20 to 50% of C2S, 20 to 70% of C12A7 and 0 to 40% of C3A.

5. The steel desulphurating agent according to claim 1, comprising, compared with the total weight of the agent, the following mineralogical phases:

10% to 30% of C2S, 30% to 60% of CA, and 10% to 40% of C2AS; or

20% to 50% of C2S, 20% to 70% of C12A7 and greater than 0% to 40% of C3A.

6. The steel desulphurating agent according to claim 1, comprising, compared with the total weight of the agent, the following mineralogical phases:

10 to 30% of C2S, 30 to 60% of CA, and 10 to 40% of C2AS; or 20 to 50% of C2S, 20 to 70% of C12A7 and 10 to 40% of C3A.

7. The desulphurating agent according to claim 1, wherein the desulphurating agent is obtained from a steelworks slag.

8. The steel desulphurating agent according to claim 2, comprising, compared with the total weight of the agent, the following mineralogical phases:

10 to 30% of C2S, 30 to 60% of CA, and 10 to 40% of C2AS; or 20 to 50% of C2S, 20 to 70% of C12A7 and 0 to 40% of C3A, preferably 10 to 40% of C3A.

9. The steel desulphurating agent according to claim 2, comprising, compared with the total weight of the agent, the following mineralogical phases:

10 to 30% of C2S, 30 to 60% of CA, and 10 to 40% of C2AS; or 20 to 50% of C2S, 20 to 70% of C12A7 and 10 to 40% of C3A.

10. The desulphurating agent according to claim 2, wherein the desulphurating agent is obtained from a steelworks slag.

11. The desulphurating agent according to claim 4, wherein the desulphurating agent is obtained from a steelworks slag.

* * * * *